US006435703B2

(12) United States Patent
Takada

(10) Patent No.: US 6,435,703 B2
(45) Date of Patent: Aug. 20, 2002

(54) VEHICULAR HEADLAMP

(75) Inventor: Kenichi Takada, Shizuoka (JP)

(73) Assignee: Koito Manufacturing Co., Ltd., Tokyo (JP)

( * ) Notice: Subject to any disclaimer, the term of this patent is extended or adjusted under 35 U.S.C. 154(b) by 0 days.

(21) Appl. No.: 09/757,707

(22) Filed: Jan. 11, 2001

(30) Foreign Application Priority Data

Jan. 12, 2000 (JP) ..... 2000-004050

(51) Int. Cl.[7] ..... F21V 7/00
(52) U.S. Cl. ..... 362/517; 362/346; 362/539
(58) Field of Search ..... 362/303, 516, 362/517, 538, 539, 346, 518; 313/114

(56) References Cited

U.S. PATENT DOCUMENTS 2,315,549 A * 4/1943 Singer ..... 313/114
4,772,987 A 9/1988 Kretschmer et al. ..... 362/61
5,119,276 A * 6/1992 Suzuki ..... 362/61
5,967,647 A 10/1999 Eichler ..... 362/304

FOREIGN PATENT DOCUMENTS

DE 40 10 830 C2 10/1991 ..... F21M/3/16

* cited by examiner

*Primary Examiner*—Sandra O'Shea
*Assistant Examiner*—John Anthony Ward
(74) *Attorney, Agent, or Firm*—Sughrue Mion, PLLC

(57) ABSTRACT

A projector-type headlamp having an improved external appearance when viewed from the front of the lamp, even when the projector-type headlamp is incorporated in a substantially vertically rectangular lamp body. The headlamp includes a pair of auxiliary reflectors 34A and 34B for reflecting light, from a light source 22, forward without passing the light therefrom through a focusing lens 28. The auxiliary reflectors are respectively provided on both vertical sides of a reflector 24 in such a way that, on the whole, the contour of the pair of auxiliary reflectors, when viewed from the front of the lamp, looks vertically rectangular. Consequently, a lamp unit 20 observed in a turned-on condition appears brighter in design than simply dimly lit as before, and when incorporated in the whole lamp, there is no feeling of wrongness between the reflector and the focusing lens.

9 Claims, 8 Drawing Sheets

VEHICULAR HEADLAMP

BACKGROUND OF THE INVENTION

1. Field of the Invention

The present invention relates to a projector-type vehicular headlamp.

2. Description of the Related Art

Projector-type headlamps have been employed as vehicular headlamps very often in recent years.

As shown in FIG. 7, the projector-type headlamp is equipped with a light source 102, a reflector 104, and a focusing lens 106. The light source 102 is substantially coaxially arranged with the optical axis Ax of a lamp, wherein the optical axis Ax extends in the longitudinal direction of a vehicle. The reflector 104 reflects light, from the light source, a little forward and toward the optical axis Ax of the lamp. The focusing lens 106 is provided in front of the reflector 104.

When the projector-type headlamp is used as a low-beam headlamp, a shielding plate 108—for shielding part of the light reflected from the reflector so as to remove the light emitted upward—is provided between the focusing lens 106 and the reflector 104 as shown in FIG. 7. Thus, a low-beam light-distribution pattern having a predetermined cutoff line is formed by the light transmitted through the focusing lens 106.

3. Problems to be Solved by the Invention

As shown in FIG. 8(*a*), however, because the focusing lens 106 of such a projector-type headlamp 110 is generally formed with a single convex lens having a circular contour when viewed from the front of the lamp, the focusing lens only appears dimly lit when it is observed from the front of the lamp and, disadvantageously, the lamp looks unattractive.

Moreover, the projector-type headlamp is often incorporated in part of the lamp body 100 and, consequently, the contour of the lamp body 100 when viewed from the front of the lamp often looks substantially vertically rectangular. Thus, it is difficult to harmonize the designs of the lamp unit 110 and the lamp body 100.

Incidentally, U.S. Pat. No. 4,772,987 and U.S. Pat. No. 5,967,647 disclose arrangements for providing auxiliary reflectors for reflecting light from light sources forward without passing the light therefrom through focusing lenses. In these arrangements, however, the auxiliary reflectors are provided on the outer peripheral side of each reflector in a projector-type headlamp.

SUMMARY OF THE INVENTION

An object of the present invention, which has been made in view of the above-described problems, is to provide a projector-type headlamp having an improved external appearance when viewed from the front of the lamp, even when the projector-type headlamp is incorporated in a substantially vertically rectangular lamp body. Another object of the present invention is to improve design harmony between the lamp unit and the lamp body.

In order to accomplish the above and other objects, according to the present invention, predetermined auxiliary reflectors are respectively provided on both vertical sides of a reflector.

A projector-type vehicular headlamp includes:

a light source substantially coaxially arranged with an optical axis of the headlamp, wherein the optical axis extends in the longitudinal direction of a vehicle;

a reflector for reflecting light, from the light source, forward and towards the optical axis of the lamp;

a focusing lens provided in front of the reflector, so that a predetermined beam emission is made by using the transmission light of the focusing lens; and a pair of auxiliary reflectors, for reflecting the light from the light source forward without passing the light therefrom through the focusing lens, respectively provided on both vertical sides of the reflector, wherein on the whole, the contour of the pair of auxiliary reflectors, when viewed from the front of the lamp, looks vertically rectangular.

The above 'light source' is not limited to a specific kind but may be, for example, a filament of such as a halogen bulb, or a discharge light emitting portion of a discharge bulb.

The above 'predetermined beam emission' is not limited to beam emission in a specific light-distribution pattern but may be, for example, beam emission in a low-beam light-distribution pattern, beam emission in a high-beam light-distribution pattern, beam emission to be made by selectively switching between the low-beam and high-beam light-distribution patterns, beam emission in a fog-lamp light-distribution pattern, and the like.

The above 'pair of auxiliary reflectors' is not limited in specific configuration to any particular length and breadth ratio, surface configuration of the reflective surface of each reflector, and the like, as long as the auxiliary reflectors: are respectively provided on both vertical sides of the reflector; on the whole, the contour of the pair of auxiliary reflectors, when viewed from the front of the lamp, looks vertically rectangular; and are used for reflecting the light from the light source forward without passing the light therefrom through the focusing lens.

Operation/Working Effect

According to the above-described arrangement, the vehicular headlamp according to the invention is provided with a pair of auxiliary reflectors for forwardly reflecting the light from the light source without passing the light therefrom through the focusing lens. The auxiliary reflectors are respectively provided on both vertical sides of the reflector in the projector-type headlamp, and the contour of the whole of the pair of auxiliary reflectors, when viewed from the front of the lamp, looks vertically rectangular and longer than it is wide, so that the following operation and working effect are achievable.

In other words, when the projector-type headlamp being electrically turned-off is observed from the front side in ambient light, the presence of the reflective surfaces of the auxiliary reflectors on both vertical sides of the focusing lens therein makes the lamp look brighter on the whole in the vertically long, rectangular, form instead of making the focusing lens simply dimly lit by ambient light as before.

When the projector-type headlamp is incorporated in the whole lamp having a substantially rectangular contour, as viewed from the front thereof, there is avoided a feeling of wrongness in lamp design between the lamp unit and the whole lamp.

According to the invention, it is possible to improve the external appearance when observed from the front of the projector-type headlamp. Moreover, an improved design harmony between the lamp unit and the lamp body is possible.

Since the projector-type headlamp according to the invention is provided with the pair of auxiliary reflectors, there is prevented an increase in the lateral tilting angle between the reflective surfaces of the auxiliary reflectors, which increase occurs where the auxiliary reflectors are provided laterally respectively on both sides of the reflector. Therefore, according to the invention, the horizontal diffusion deflecting reflection control can be made by the auxiliary reflectors with greater precision.

According to the invention, the light reflected from the pair of auxiliary reflectors can be utilized for reinforcing the brightness of the light-distribution pattern formed by the light reflected from the reflector.

Also, a shielding plate for shielding part of the light reflected from the reflector so as to remove the light emitted upward is provided between the reflector and the focusing lens. Thus, in the projector-type headlamp formed to make the beam emission with the low-beam light-distribution pattern having a predetermined cutoff line formed by the shielding plate, it is possible to utilize the light reflected from the pair of auxiliary reflectors as the light for correcting the low-beam light-distribution pattern, irradiating the overhead sign and the like.

In that case, at least part of reflective areas of the pair of auxiliary reflectors is so arranged as to reflect the light from the light source toward the cutoff line with the following effect.

In the projector-type headlamp, the cutoff line of the low-beam light-distribution pattern has an extremely high brightness-to-darkness ratio. Consequently, for example, when the vehicle travels from a downward slope toward a flat road, the driver comes across a situation where he may hardly drive the car forward on the road surface because it has become suddenly dim, thus lowering visibility. Moreover, because of vertical pitching of the vehicle, and the like, the driver may give glaring light to an oncoming vehicle. Therefore, the light from the light source is reflected toward the cutoff line by utilizing the auxiliary reflectors thereby easing the brightness-to-darkness ratio so that it is easier for the driver to drive his/her own car with a low-beam light-distribution pattern that may give any on-coming vehicle driver a low-beam light-distribution pattern without glaring light.

Although the lateral breadth of each auxiliary reflector is not limited to any specific value, it can make the lamp appear rectangular, and substantially vertically longer when lit, thus improving the novel design of the lamp.

Alternatively, the contour of the focusing lens, when viewed from the front of the lamp, is obtainable by cutting out of the focusing lens both lateral end portions of a circle, and by setting the lateral breadth of each auxiliary reflector substantially equal in value to the lateral breadth of the focusing lens. When the lateral breadth of each auxiliary reflector is set smaller than that of the focusing lens, as when the focusing lens is allowed to stick out laterally beyond each auxiliary reflector, the lamp can appear rectangular and substantially vertically longer when lit by ambient light so as to improve the novel design of the lamp.

Although the reflective surface of each of the auxiliary reflectors is not limited to any specific form as described above, the substantially vertically long and rectangular configuration of the lamp can be strengthened further by forming the reflective surface with a plurality of dividing reflective elements.

BRIEF DESCRIPTION OF THE DRAWINGS

The above and other objects and advantages of the present invention will become more apparent by describing in detail preferred exemplary embodiments thereof with reference to the accompanying drawings, wherein like reference numerals designate like or corresponding parts throughout the several views, and wherein.

DETAILED DESCRIPTION OF PREFERRED EMBODIMENTS OF THE INVENTION

An embodiment of the invention will now be described with reference to the drawings.

Figure 1:
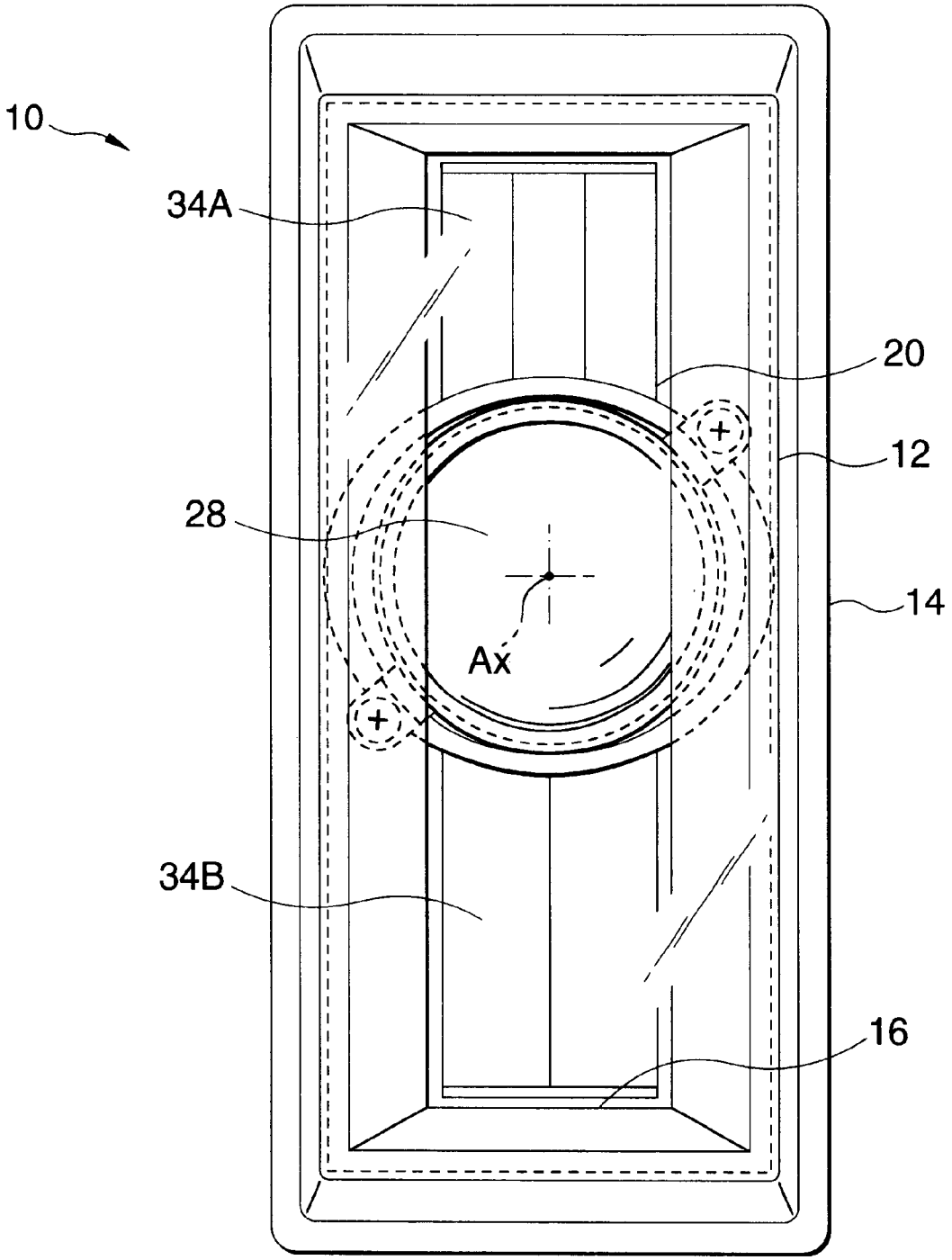
FIG. 1 is an elevational view of a vehicular headlamp embodying the invention.
Figure 2:
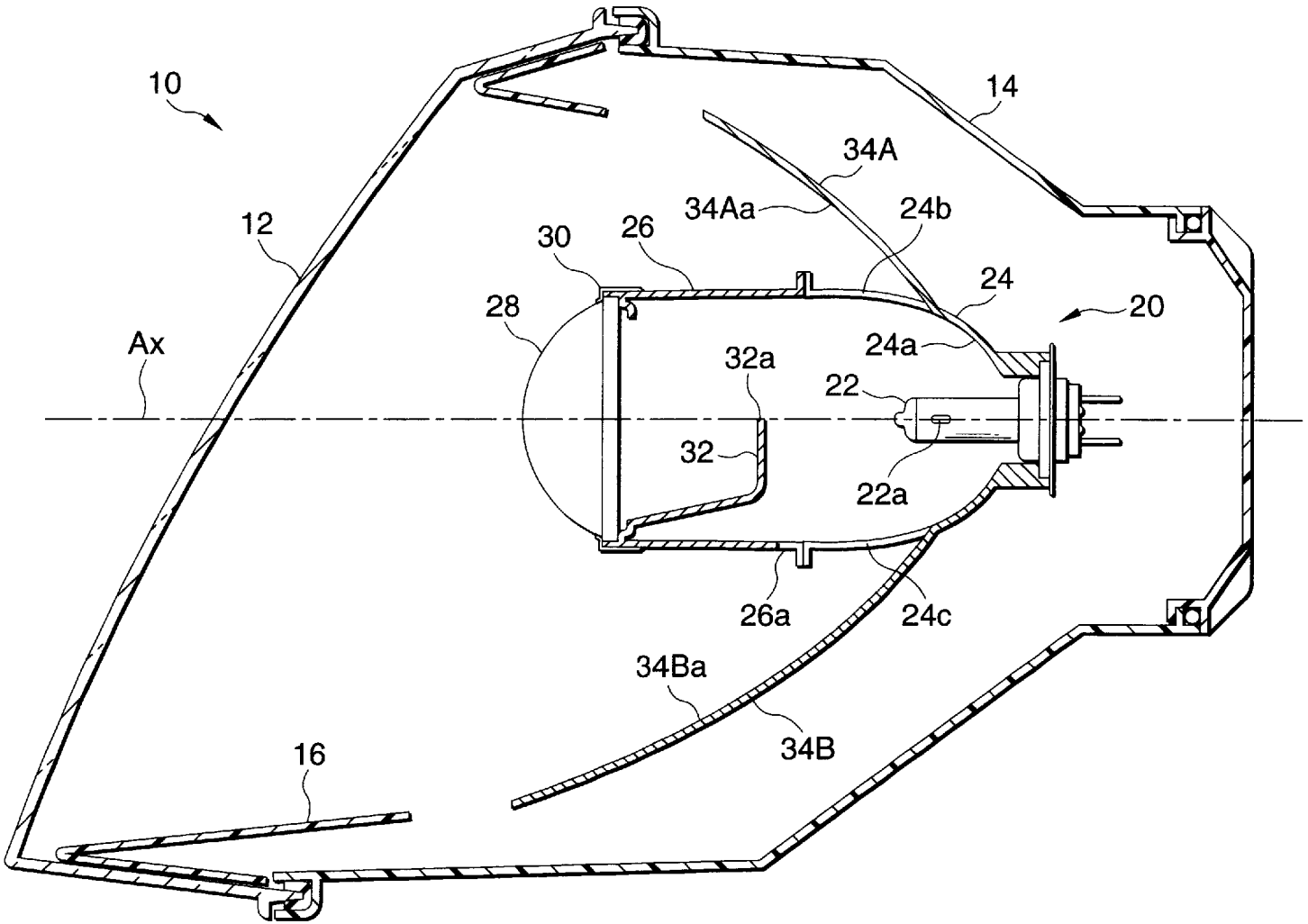
FIG. 2 is a cross-sectional side view of the vehicular headlamp as shown in FIG. 1.

FIGS. 1 and 2 are an elevational and a sectional side view of a vehicular headlamp 10 embodying the invention.

As shown in those drawings, the vehicular headlamp 10 according to this embodiment of the invention is a lamp having a rectangular contour that looks taller than it is broad in elevational view. In a lamp chamber formed with a front lens 12 and a lamp body 14, a lamp unit 20 is set tiltable vertically and laterally by an aiming mechanism on the optical axis Ax of the lamp extended in the longitudinal direction of a vehicle. Further, an extension panel 16 is provided close to the rear of the front lens 12 in such a manner as to surround the lamp unit 20.

The front lens 12 is formed with a plain-glass lens tilting backward from the lower end portion toward the upper end portion thereof.

Figure 3:
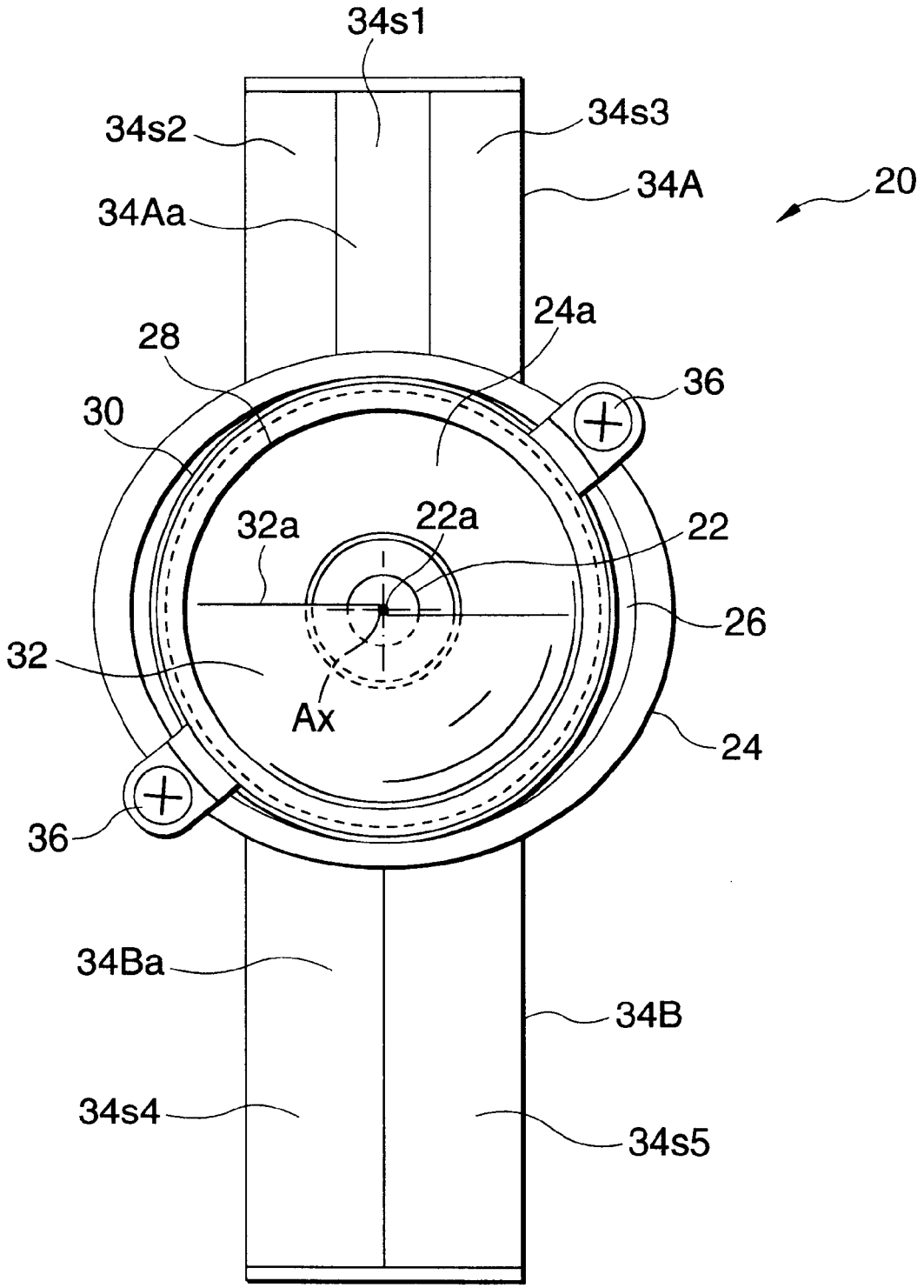
FIG. 3 is an elevational view of a single lamp unit in the vehicular headlamp.
Figure 4:
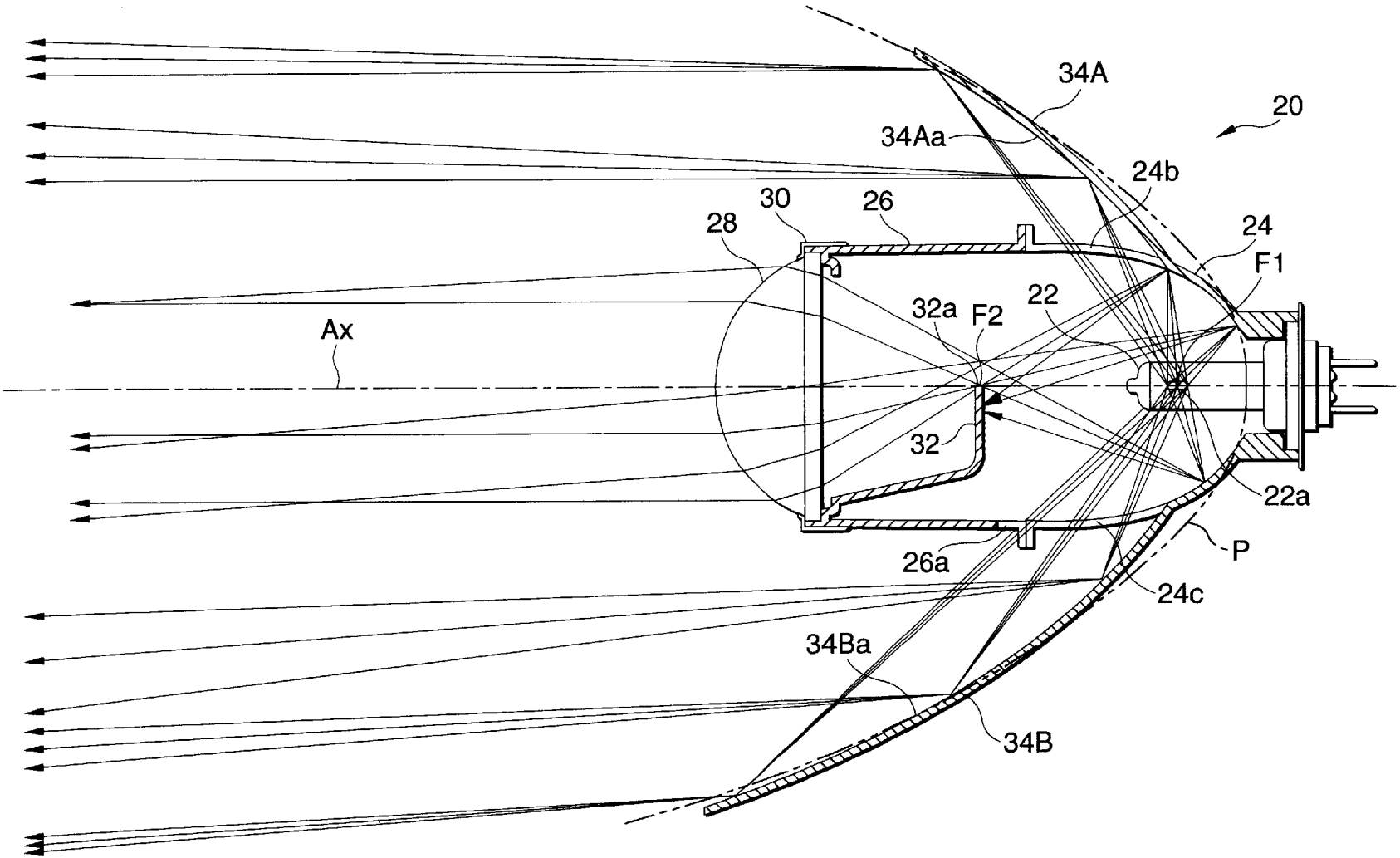
FIG. 4 is a sectional side view of the single lamp unit as shown in FIG. 3.

FIGS. 3 and 4 are an elevational and a sectional side view of the lamp unit 20 in the form of a single article.

As shown in those drawings, the lamp unit 20 is an improved version of a projector-type low-beam headlamp including a light-source bulb 22, a reflector 24, a holder 26, a focusing lens 28, a retaining ring 30, a shielding plate 32, and a pair of auxiliary reflectors 34A and 34B.

The light-source bulb 22 is a halogen bulb, having a single filament as a light source 22*a*, and is mounted in the rear top portion of the reflector 24 so that the light source 22*a* may be arranged coaxially with the optical axis Ax of the lamp.

The reflector 24 has a substantially elliptical spherical reflective surface 24*a* with the optical axis Ax of the lamp as a central axis. The reflective surface 24*a* is formed with an ellipse in section including the optical axis Ax of the lamp and is set so that its eccentricity may become gradually greater from the vertical section toward the horizontal section. However, the apex on the rear side of the ellipse forming each section is set in the same position. The light source 22*a* is placed at the first focus point F1 of the ellipse forming the vertical section of the reflective surface 24, whereby the reflective surface 24*a* is so arranged as to reflect light, from the light source 22*a*, a little forward and toward the optical axis of the lamp so that the light is substantially converged at the second focus point F2, wherein the second focus point F2 is a focus point of the ellipse within the vertical section including the optical axis Ax of the lamp.

The holder 26 is extendable forward from the front-end opening portion of the reflector 24 and is formed into a cylindrical shape. Additionally, reflector 24 is fixedly coupled to the rear end portion of the holder 26. Further, the retaining ring 30, for holding the focusing lens 28, is fixed by screws 36 in two places of the front-end portion of the holder 26.

The focusing lens 28 is formed with a flat convex non-spherical lens whose surface on the front side is convex non-spherical and whose surface on the rear side is planar, so that the focus point position on the rear side is so placed as to coincide with the second focus point F2 of the reflective surface 24*a*. Accordingly, the focusing lens 28 is able to focus and pass the light reflected from the reflective surface 24*a* a little forward and toward the optical axis Ax of the lamp.

The shielding plate 32 is positioned in the lower portion of the inner space of the holder 26 and is formed integrally with the holder 26. The shielding plate 32 removes the upward light emission from the lamp unit 20 by shielding part of the light reflected from the reflective surface 24*a* in order to obtain a downward low-beam light emission with respect to the optical axis Ax of the lamp. The upper end edge 32*a* of the shielding plate 32 is made to pass the second focus point F2 and is laterally formed on a different level.

The auxiliary reflectors 34A and 34B are respectively provided on both vertical sides of the reflector 24 and also are formed integrally with the reflector 24. More specifically, cutout openings 24*b* and 24*c* are respectively formed in the upper and lower front end portions of the reflector 24, and the auxiliary reflectors 34A and 34*b* are respectively extended in a concave curved form forward obliquely from the rear end edges of the cutout openings 24*b* and 24*c*. The light from the light source 22*a* is made incident on the reflective surfaces 34A*a* and 34B*a* of the respective auxiliary reflectors 34A and 34B via the cutout openings 24*b* and 24*c*. In order that light may be made incident on the whole area of the reflective surface 34B*a*, a cutout opening 26*a* is also formed in the lower rear end portion of the holder 26.

On the whole, the contour of the pair of auxiliary reflectors 34A and 34B, when viewed from the front of the lamp, is set vertically rectangular. Additionally, the breadth of each of the auxiliary reflectors 34A and 34B is set smaller in value than the breadth of the focusing lens 28. As shown in FIG. 1, further, the contour of the inner peripheral edge of the extension panel 16, when viewed from the front of the lamp, is set rectangular and slightly vertically greater than the contour of the whole of both auxiliary reflectors 34A and 34B so as to cover both lateral end portions of the focusing lens 28.

As shown in FIG. 4, the reflective surfaces 34A*a* and 34B*a* of the respective reflectors 34A and 34B are formed with a rotary parabolic surface P with the optical axis Ax of the lamp as the central axis and with the first focus point F1 as a focus point.

As shown in FIG. 3, the reflective surface 34A*a* includes three reflective elements 34*s*1, 34*s*2 and 34*s*3 that are divided by vertical stripes, whereas the reflective surface 34B*a* includes two reflective elements 34*s*4 and 34*s*5 that are divided by vertical stripes. With these reflective elements 34*s*1, 34*s*2, 34*s*3, 34*s*4 and 34*s*5, the light from the light source 22*a* is subjected to forward diffusion deflective reflection without passing the light through the focusing lens 28.

Figure 5:
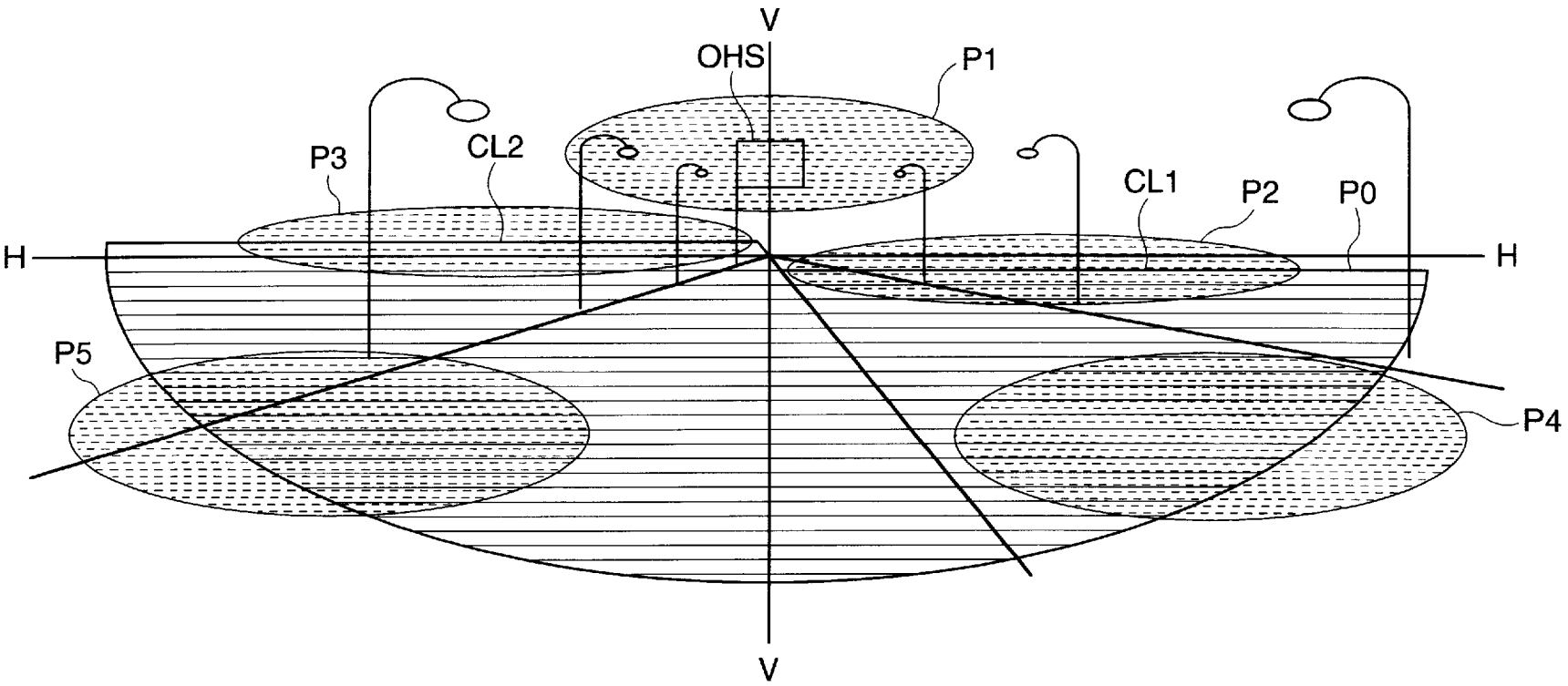
FIG. 5 is a low-beam light-distribution pattern emitted forward from the lamp unit.

FIG. 5 shows the low-beam light-distribution pattern emitted forward from the lamp unit 20.

As shown in FIG. 5, the light-distribution pattern is formed with a low-beam basic light-distribution pattern Po, and five auxiliary light-distribution patterns P1, P2, P3, P4 and P5.

The low-beam basic light-distribution pattern Po is a left light-distribution pattern formed by the light reflected from the reflector 24 and has horizontal cutoff lines CL1 and CL2 that are different in vertical level. These horizontal cutoff lines CL1 and CL2 are formed as images projected on the upper end edge 32*a* of the shielding plate 32.

The auxiliary light-distribution pattern P1 is a light-distribution pattern for irradiating an overhead sign (OHS) provided in a space above the road surface ahead of the vehicle, and is formed by the light reflected from the reflective element 34*s*1 of the auxiliary reflector 34A.

Further, the auxiliary light-distribution patterns P2 and P3 are light-distribution patterns for irradiation toward the horizontal cutoff lines CL1 and CL2, and are formed by the light reflected from the reflective elements 34*s*2 and 34*s*3 of the auxiliary reflector 34A.

Moreover, the auxiliary light-distribution patterns P4 and P5 are light-distribution patterns for irradiation toward portions close to the lower end edges of both lateral end portions in the low-beam basic light-distribution pattern Po, and are formed by the light reflected from the reflective elements 34*s*4 and 34S5 of the auxiliary reflector 34B.

As set forth above in detail, the vehicular headlamp 10 according to this embodiment of the invention is provided with the lamp unit 20 formed with the projector-type headlamp, and is provided with the pair of auxiliary reflectors 34A and 34B for reflecting the light from the light source 22 forward without passing the light therefrom through the focusing lens 28, wherein the auxiliary reflectors 34A and 34B are provided on both vertical sides of the reflector 24. In addition, on the whole, the contour of the pair of auxiliary reflectors 34A and 34B, when viewed from the front of the lamp, is set vertically long and rectangular. Consequently, the following operation and working effect are obtainable.

When the projector-type headlamp being electrically turned-off is observed from the front side in ambient light, the presence of the reflective surfaces of the auxiliary reflectors on both vertical sides of the focusing lens therein makes the lamp look brighter on the whole in the vertically long, rectangular, form instead of making the focusing lens simply dimly lit by ambient light as before.

When the projector-type headlamp is incorporated in the whole lamp having a substantially rectangular contour, as viewed from the front thereof, there is prevented a feeling of wrongness in lamp design between the lamp unit and the whole lamp.

According to the invention, it is possible to improve the external appearance when observed from the front of the projector-type headlamp. Moreover, an improved design harmony between the lamp unit and the lamp body is possible.

Since the projector-type headlamp according to the invention is provided with the pair of auxiliary reflectors, there is prevented an increase in the lateral tilting angle between the reflective surfaces of the auxiliary reflectors, wherein such increase is present when the auxiliary reflectors are provided laterally respectively on both sides of the reflector. Therefore, according to the invention, the horizontal diffusion deflecting reflection control can be made by the auxiliary reflectors with greater precision.

According to the invention, the light reflected from the pair of auxiliary reflectors can be utilized for increasing the brightness of the light-distribution pattern Po formed by the light reflected from the reflector and, moreover, such light can be utilized as follows.

The visibility of an overhead sign OHS can be increased by using the light reflected from the reflective element 34*s*1. Additionally, the driver driving his/her own car is allowed to easily see while letting a driver in any oncoming car obtain a low-beam light-distribution pattern that may give less glaring light by emitting the light reflected from the reflective elements 34*s*1 and 34*s*2 toward the horizontal cutoff lines CL1 and CL2. Further, the visibility of both lateral portions of the road surface in the proximity of the vehicle can be increased by irradiating the portions close to the lower end edges of both the lateral end portions of the low-beam basic light-distribution pattern Po from the light reflected from the reflective elements 34*s*4 and 34*s*5.

When it is attempted to form the auxiliary light-distribution patterns P1, P2, P3, P4 and P5, having the above-described functions, from the light reflected from the reflector 24, the lamp unit 20 tends to become extremely complicated. However, the formation of the light reflected from both auxiliary reflectors 34A and 34B according to this embodiment of the invention makes it easier to form any necessary auxiliary light-distribution pattern.

The provision of the pair of auxiliary reflectors 34A and 34B on both the respective vertical sides of the reflector 24 prevents the lateral tilting angle of the reflective surfaces of the auxiliary reflectors 34A and 34B from becoming greater than a case where the auxiliary reflectors 34A and 34B are respectively provided on both lateral sides of the reflector 24. Therefore, according to this embodiment of the invention, the horizontal diffusion deflecting reflection control can be made by the auxiliary reflectors 34A and 34B with greater precision.

Because the breadth of each of the auxiliary reflectors 34A and 34B is set smaller in value than the breadth of the focusing lens 28, the lamp unit 20 appears bright vertically long and rectangular, whereby the lamp can maintain a novel lamp design. Also, because both lateral end portions of the focusing lens 28 are covered with the extension panel 16, it is possible to strengthen the vertically long, rectangular, configuration of the lamp unit 20. Further, the reflective surfaces 34A*a* and 34B*a*, of the respective auxiliary reflectors 34A and 34B, are respectively composed of the plurality of reflective elements 34*s*1, 34*s*3, 34*s*3, 34*s*4 and 34*s*5 having vertical stripes in order to increase the vertically long, rectangular, configuration of the lamp unit 20.

According to this embodiment of the invention, because the holder 26 and the retaining rings 30 are fixed with tilted set screws on both sides of the lamp unit 20, the lateral breadth of the lamp unit 20 can be made shorter than it is horizontally situated, so that the whole lamp 10 can be formed into a vertically long, rectangular shape.

Figure 6:
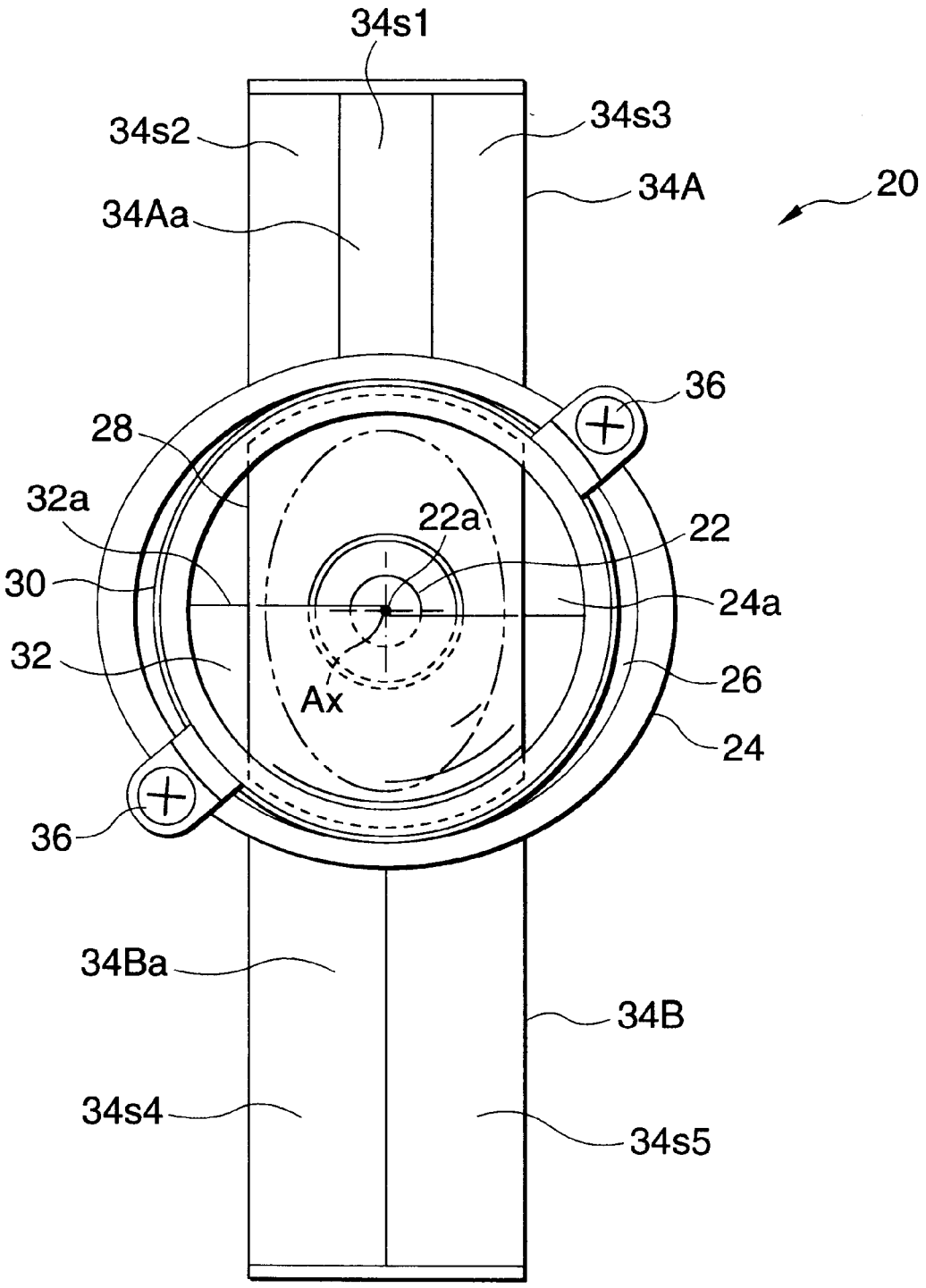
FIG. 6 is a modified example of the above-shown embodiment and is similar to the view shown in FIG. 3.
Figure 7:
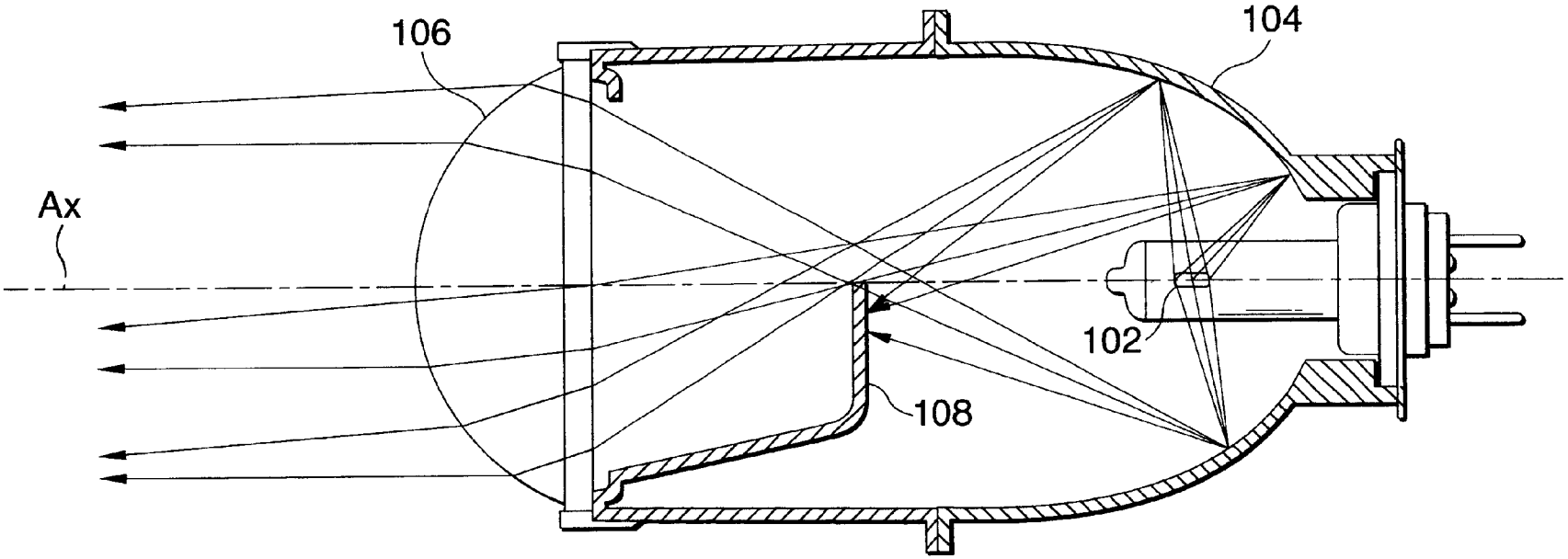
FIG. 7 PRIOR ART
FIG. 7 is a conventional example of a projector-type headlamp, and is similar to the view shown in FIG. 4.
Figure 8B:
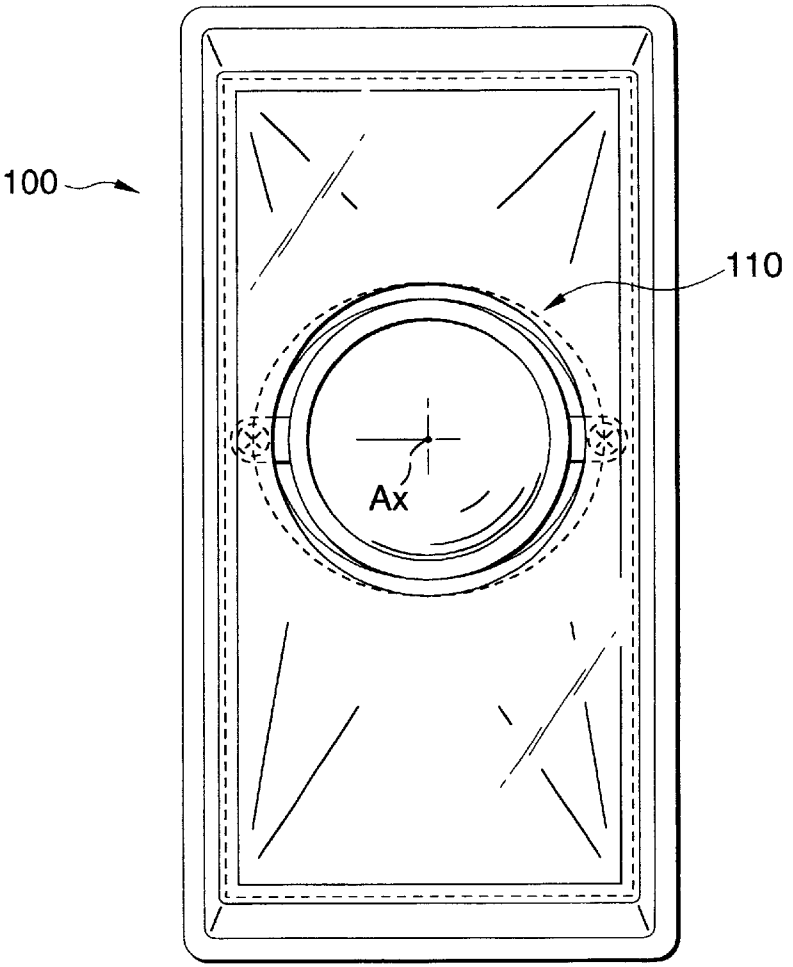
FIG. 8(b) PRIOR ART
FIG. 8 is a conventional example of a projector-type headlamp, wherein FIG. 8(*a*) is similar to the view shown in FIG. 3, and FIG. 8(*b*) is similar to the view shown in FIG. 1.
Figure 8A:
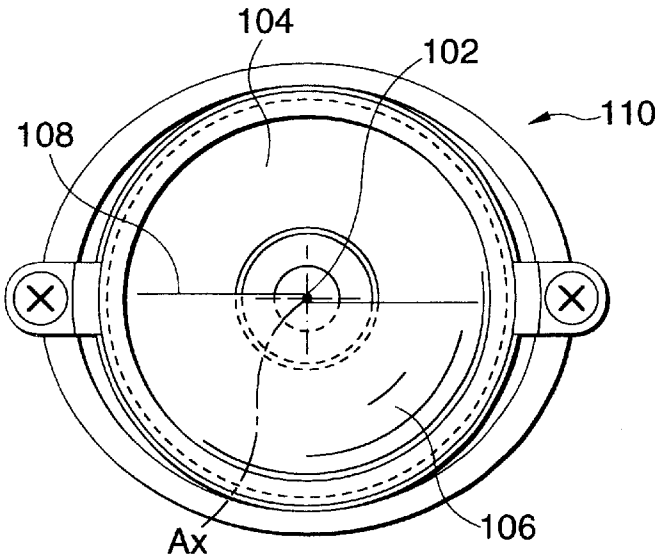
FIG. 8(a) PRIOR ART

According to a second embodiment of the invention, as shown in FIG. 6, the contour of the focusing lens, when viewed from the front of the lamp, is obtained by cutting out both lateral end portions of a circle. Also, the lateral breadth of each auxiliary reflector is set substantially equal in value to the lateral breadth of the thusly-formed focusing lens. As in the case where the lateral breadth of each auxiliary reflector is set smaller than the focusing lens which thereby is allowed to stick laterally out from each auxiliary reflector, the lamp according to this embodiment appears brighter, rectangular, and substantially vertically longer when lit by ambient light so as to improve the novel design of the lamp.

With the formation of the partial circular focusing lens 28, the area where the light reflected from the reflector 24 is incident becomes vertically long and rectangular as shown by chain double-dashed lines. Therefore, no trouble occurs in forming the low-beam basic light-distribution pattern Po resulting from vertically cutting both end portions of the circle.

Additionally, the partially circular focusing lens 28 is usable to make both lateral sides of the internal and outer spaces of the lamp unit 20 communicate with each other. Therefore, it is possible to ventilate between the cutout openings 24*b* and 24*c* formed in the reflector 24 together with the cutout opening 26*a* formed in the holder 26. Thus, this ventilation is effective in preventing overheating of the peripheral portion of the light-source bulb 22 of the reflector 24.

Although a description has been given of the auxiliary reflectors 34A and 34B formed in combination with the reflector 24, these auxiliary reflectors 34A and 34B may be formed separately from the reflector 24 yet still achieve the same effects.

The present invention is not limited to the specific above-described embodiments. It is contemplated that numerous modifications may be made to the vehicular headlamp of the present invention without departing from the spirit and scope of the invention as defined in the following claims.

What is claimed is:

1. A projector-type vehicular headlamp comprising:

a light source substantially coaxially arranged with an optical axis of the headlamp, wherein the optical axis extends in the longitudinal direction of a vehicle;

a reflector for reflecting light, from said light source, forward and towards the optical axis of said lamp;

a focusing lens provided in front of said reflector, so that a predetermined beam emission is made by using the transmission light of said focusing lens; and a pair of auxiliary reflectors, for reflecting the light from said light source forward without passing the light therefrom through said focusing lens, respectively provided on both vertical sides of said reflector, wherein on the whole, the contour of the pair of auxiliary reflectors, when viewed from the front of said lamp therefore, vertically rectangular.

2. A vehicular headlamp as claimed in claim 1, wherein a shielding plate, for shielding part of the light reflected from said reflector so as to remove the light emitted upward, is provided between said reflector and said focusing lens, whereby a low-beam light-distribution pattern having a predetermined cutoff line is formed by said shielding plate to make said predetermined beam emission.

3. A vehicular headlamp as claimed in claim 2, wherein the breadth of each auxiliary reflector is set smaller in value than the breadth of said focusing lens.

4. A vehicular headlamp as claimed in claim 2, wherein the contour of said focusing lens when viewed from the front of said lamp is set partially circular in that both lateral end portions of a circle are cut off, and wherein the breadth of each auxiliary reflector is set substantially equal to that of said focusing lens.

5. A vehicular headlamp as claimed in claim 2, wherein at least part of at least one of said pair of auxiliary reflectors is so arranged as to reflect the light from said light source toward said cutoff line.

6. A vehicular headlamp as claimed in claim 2, wherein a reflective surface of each auxiliary reflector includes a plurality of reflective elements divided by vertical stripes.

7. A vehicular headlamp as claimed in claim 1, wherein the breadth of each auxiliary reflector is set smaller in value than the breadth of said focusing lens.

8. A vehicular headlamp as claimed in claim 1, wherein the contour of said focusing lens when viewed from the front of said lamp is set partially circular in that both lateral end portions of a circle are cut off, and wherein the breadth of each auxiliary reflector is set substantially equal to that of said focusing lens.

9. A vehicular headlamp as claimed in claim 1, wherein a reflective surface of each auxiliary reflector includes a plurality of reflective elements divided by vertical stripes.

* * * * *